United States Patent [19]

Florian

[11] 4,273,249

[45] Jun. 16, 1981

[54] SANDWICH CONTAINER

[75] Inventor: John Florian, Bakersfield, Calif.

[73] Assignee: Mobil Oil Corporation, New York, N.Y.

[21] Appl. No.: 808,755

[22] Filed: Jun. 22, 1977

Related U.S. Application Data

[63] Continuation of Ser. No. 513,601, Oct. 10, 1974, abandoned.

[51] Int. Cl.[3] ..... B65D 1/26; B65D 17/28

[52] U.S. Cl. ..... 220/4 E; 220/339; 229/2.5 R; 229/44 R; 229/DIG. 13

[58] Field of Search ..... 220/4 E, 339; 229/2.5, 229/44 R, DIG. 13

[56] References Cited

U.S. PATENT DOCUMENTS

| | | | |
|---|---|---|---|
| 2,798,784 | 7/1957 | Marshall | 220/4 E |
| 2,915,214 | 12/1959 | Frankel | 220/339 |
| 2,917,216 | 12/1959 | Despres | 229/2.5 |
| 3,148,103 | 9/1964 | Gallagher | 220/339 |
| 3,438,826 | 4/1969 | Van Eikeren | 229/2.5 |
| 3,511,433 | 5/1970 | Andrews | 229/44 R |
| 3,586,162 | 6/1971 | Townsend | 220/4 E |

*Primary Examiner*—George E. Lowrance
*Attorney, Agent, or Firm*—C. A. Huggett; M. G. Gilman

[57] ABSTRACT

A package for generally circular sandwiches has two semi-circular pockets or recesses provided with flanges about the open edge of each. The flanges are connected by a hinge to facilitate closing and opening of the package.

2 Claims, 5 Drawing Figures

FIG. 2
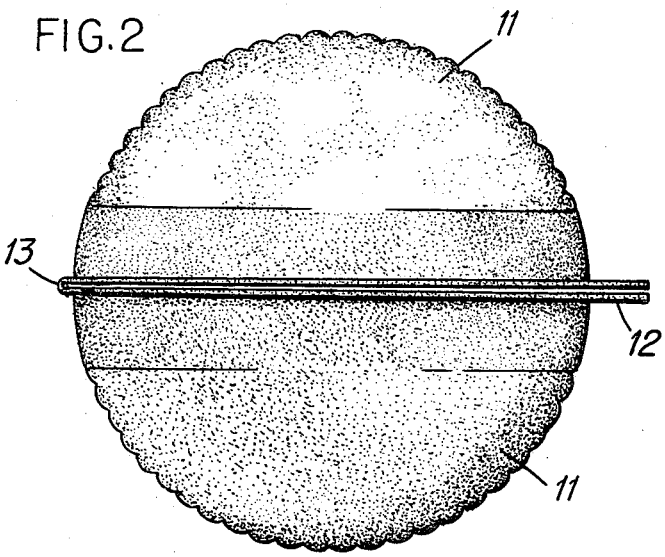
FIG. 3
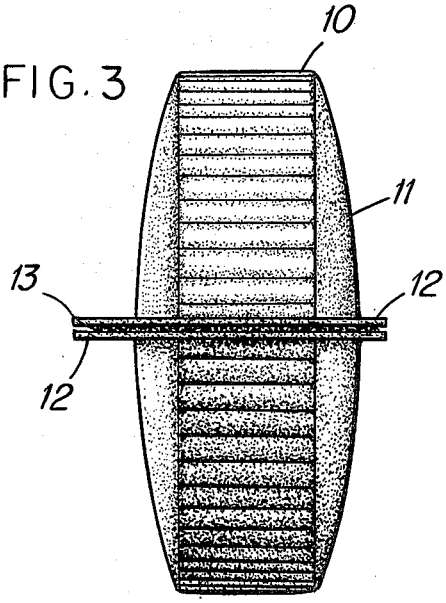
FIG. 1
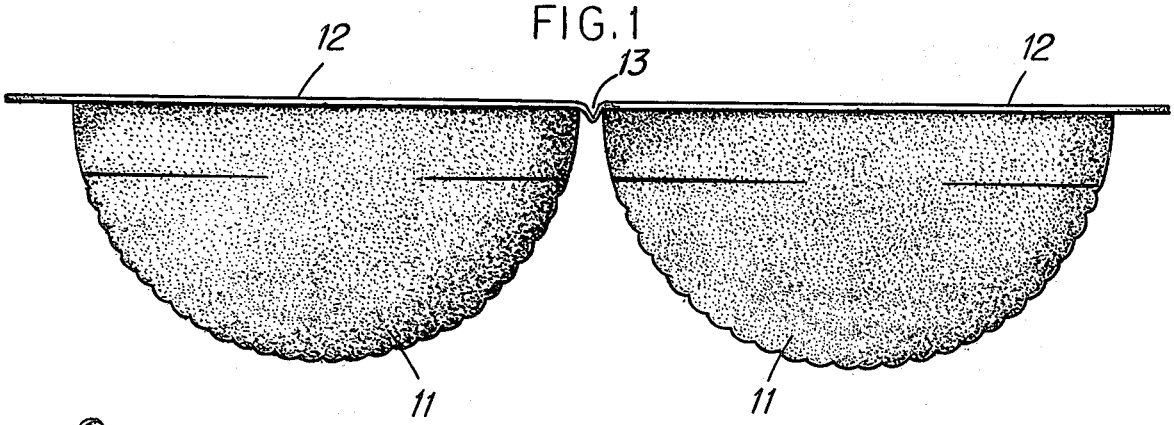
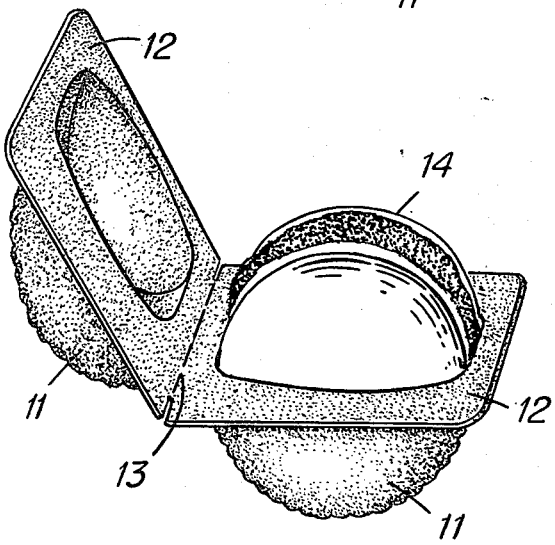
FIG. 4
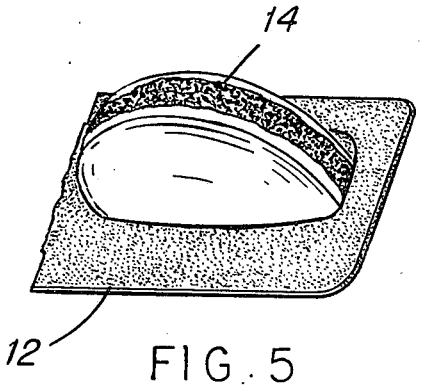
FIG. 5

SANDWICH CONTAINER

CROSS-REFERENCE TO RELATED APPLICATIONS

The present application is a continuation application of U.S. Ser. No. 513,601 filed Oct. 10, 1974, now abandoned.

FIELD OF THE INVENTION

The invention pertains to protective packages particularly suited to storage, transport, marketing, and consumption of foods, such as sandwiches of generally circular form. Such packages have been formed of various materials such as resins, chip board, molded pulp, and the like.

More particularly, it is known to provide thermoformed resin hamburger packages constituted by two circular pockets hinged along one side to form a circular enclosure when the halves are rotated about the hinge.

SUMMARY OF THE INVENTION

According to the present invention, a type of enclosure superior to that described above for circular enclosure is achieved by providing the juncture between package halves along a plane in the axis of the circular enclosure as compared to the juncture normal to that axis in similar articles of manufacture known to the prior art. The specific nature and advantages of the invention will be apparent from description below of a preferred embodiment when considered with the annexed drawings.

BRIEF DESCRIPTIONS OF DRAWINGS

FIG. 1 is a side view of a thermoformed container according to the invention in open state as it comes from a thermoformer;

FIG. 2 is a side view of the container in closed state;

FIG. 3 is an end view of the container of FIG. 2;

FIG. 4 illustrates how a circular sandwich extends from one half of the open container for ease of consumption; and FIG. 5 illustrates how the container may be divided and rested on a surface in a manner to prevent loss of juices, condiments, sauces and the like.

DESCRIPTION OF PREFERRED EMBODIMENT

The container is comprised by two substantially identical halves, each having a semi-circular pocket or recess defined by a semi-circular wall 10 and two side walls 11. About the mouth or open face of each pocket is a flange 12, the flanges of the two halves being integral, one with the other, and having a hinge line 13 at the juncture of the flanges.

The container is well adapted to high speed thermoforming operations and has been so formed with smooth, high gloss surfaces from foamed polystyrene despite the deep draw involved in forming the semi-circular pockets. In its preferred embodiment the exterior semi-circular wall is formed with a fluted surface, as shown in FIG. 3.

In use, a circular sandwich such as a hamburger, barbeque, or the like is placed in one of the pockets 11 and the empty pocket is rotated about the hinge 13 to close the package. The food product is thus protected against heat loss. Equally important, the integrity of the food is protected against crushing or other structural distortion.

When it is desired to consume the contents, the package is held in vertical position and the upper half is rotated about the hinge 13 to expose the contents, such as a sandwich indicated generally at 14. This makes it possible to consume the sandwich above a well constituted by the lower half of the package to receive and retain juices, condiments, sauces, and the like, thus protecting the clothing of the consumer.

As best seen in FIGS. 3 and 5, the flange along one side of the package is wider than that on the opposite side. This provides convenience in setting the packaged sandwich aside without risk of staining clothing or the surface on which the sandwich is rested. Preferably, in such case, one half of the package is torn away along the weakened hinge line 13 and discarded. The remaining part of the package is rested on the wide portion of the flange, causing juices, condiments, and sauces to drain to the low end of the pocket, where they are retained. Locking the two halves together can be accomplished in the customary manner.

I claim:

1. A disposable container of foamed thermoplastic resin for dispensing a circular sandwich and for convenient cosumption of such sandwich from a portion of the container comprising two generally similar recesses each defined by two semi-circular walls and a side walls integral with each edge of said semi-circular walls, the radius of said semi-circular walls being greater than the spacing of said side walls, the said recesses being adapted to enclose a circular sandwich with a portion thereof disposed in each recess when the said recesses are placed in abutting relation of the openings of said recesses, a flange integral with the semi-circular and side walls of each recess and extending outwardly therefrom, a hinge constituting a line of weakened area of the container integral with the flange of each recess extending from one end of the semi-circular wall thereof and parallel to such end, whereby the portions of the container may be separated by tearing along said weakened area to expose said circular sandwich projecting from one of said portions for convenient consumption with retention of liquids dripping from said sandwich in said recess to avoid soiling by said liquids; the flange integral with one side wall of each of said recesses being of a width adapted to cause the adjacent side wall to slope downward from the opening of the recess when the container or one portion thereof is at rest supported on a surface by a flange of such width and the adjacent side wall to assure retention of liquids in the container or portion thereof.

2. A container according to claim 1 having the flange portion integral with one said side wall of substantially greater width than the flange portion integral with the other said side wall.

* * * * *